US008118646B2

(12) United States Patent
Sato et al.

(10) Patent No.: US 8,118,646 B2
(45) Date of Patent: Feb. 21, 2012

(54) CARRIER FOR DOUBLE-SIDE POLISHING APPARATUS, DOUBLE-SIDE POLISHING APPARATUS USING THE SAME, AND DOUBLE-SIDE POLISHING METHOD

(75) Inventors: Kazuya Sato, Nishishirakawa (JP); Junichi Ueno, Nishishirakawa (JP); Syuichi Kobayashi, Nishishirakawa (JP); Hideo Kudo, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 13/055,302

(22) PCT Filed: Jul. 23, 2009

(86) PCT No.: PCT/JP2009/003457

§ 371 (c)(1),
(2), (4) Date: Jan. 21, 2011

(87) PCT Pub. No.: WO2010/021086

PCT Pub. Date: Feb. 25, 2010

(65) Prior Publication Data

US 2011/0124271 A1 May 26, 2011

(30) Foreign Application Priority Data

Aug. 20, 2008 (JP) ..... 2008-211529

(51) Int. Cl.
*B24B 1/00* (2006.01)

(52) U.S. Cl. ..... 451/41; 451/287; 451/398

(58) Field of Classification Search ..... 451/41, 451/63, 285, 286, 287, 397, 398
See application file for complete search history.

(56) References Cited

U.S. PATENT DOCUMENTS

| | | | | |
|---|---|---|---|---|
| 6,623,343 | B2 * | 9/2003 | Kajiwara et al. | 451/398 |
| 2004/0198193 | A1 * | 10/2004 | Tajima et al. | 451/41 |
| 2008/0318493 | A1 | 12/2008 | Aida | |

FOREIGN PATENT DOCUMENTS

| | | |
|---|---|---|
| JP | A-57-157453 | 10/1982 |
| JP | A-2000-198065 | 7/2000 |
| JP | 2000280167 A * | 10/2000 |
| JP | A-2000-288921 | 10/2000 |
| JP | A-2004-241723 | 8/2004 |
| JP | A-2005-158798 | 6/2005 |
| JP | A-2006-068895 | 3/2006 |

OTHER PUBLICATIONS

International Search Report issued in Application No. PCT/JP2009/003457; Dated Sep. 8, 2009.

* cited by examiner

*Primary Examiner* — Eileen P. Morgan
(74) *Attorney, Agent, or Firm* — Oliff & Berridge, PLC

(57) ABSTRACT

A carrier for a double-side polishing apparatus, including at least: a carrier base placed between upper and lower turn tables, the carrier base having a holding hole therein, the holding hole holds the wafer sandwiched between the upper and lower turn tables. A ring-shaped resin ring disposed along an inner circumference of the holding hole, the resin ring protecting a chamfered portion by making contact with the chamfered portion of the held wafer, wherein the resin ring has a concave groove on an inner circumference thereof, upper and lower tapered surfaces are formed in the concave groove. A double-side polishing apparatus using the carrier and a double-side polishing method that can reduce the generation of taper in a polished surface and improve the flatness while suppressing the generation of an outer peripheral sag of the wafer.

3 Claims, 3 Drawing Sheets

CARRIER FOR DOUBLE-SIDE POLISHING APPARATUS, DOUBLE-SIDE POLISHING APPARATUS USING THE SAME, AND DOUBLE-SIDE POLISHING METHOD

TECHNICAL FIELD

The present invention relates to a carrier for a double-side polishing apparatus, the carrier holding a wafer when the wafer is polished in a double-side polishing apparatus, and a double-side polishing method using the apparatus.

BACKGROUND ART

When both surfaces of a wafer are simultaneously polished by polishing or the like, the wafer is held by a carrier for a double-side polishing apparatus. The carrier for a double-side polishing apparatus is formed so as to be thinner than the wafer and has a holding hole for holding the wafer at a predetermined position between an upper turn table and a lower turn table of a double-side polishing apparatus. The wafer is inserted into the holding hole and is held thereby, the upper and lower surfaces of the wafer are sandwiched by polishing tools such as polishing pads provided on the faces of the upper turn table and the lower turn table, the faces at which the turn tables face each other, and polishing is performed while a polishing agent is supplied to the polished surface.

Here, the carrier for a double-side polishing apparatus, the carrier used for such double-side polishing of a wafer, is mostly made of metal.

It is for this reason that a resin ring is attached along an inner circumferential portion of the holding hole to protect an edge portion of the wafer from damage caused by the metal carrier for a double-side polishing apparatus.

As described above, by performing polishing after attaching the resin ring between the holding hole of the carrier and the wafer, the edge portion of the wafer can be prevented from being damaged.

However, when double-side polishing is performed in the above-described manner, if pressure is concentrated on the outer circumferential portion of the wafer, only the outer circumferential portion of the wafer is excessively polished due to, for example, the influence of the viscoelasticity of a polishing slurry or the polishing pad, so that an outer peripheral sag is generated. This outer peripheral sag is one of the causes of deterioration of the flatness of the wafer.

Incidentally, regarding the flatness of the wafer, it has been known that, by making the wafer held in the holding hole of the carrier for a double-side polishing apparatus rotate at the time of double-side polishing, it is possible to prevent the generation of taper in the polished surface of the wafer and thereby improve the flatness.

Moreover, as a method for reducing the peripheral sag described above, a method in which a second double-side polishing process for correcting the peripheral sag generated in a first double-side polishing process is performed has been disclosed (refer to Patent Literature 1).

However, this method is disadvantageous in that the number of processes is increased because the second double-side polishing process for correcting the outer peripheral sag is performed, and a double-side polishing method that can reduce the outer peripheral sag more easily has been sought after.

Furthermore, a method for producing a wafer, the method in which a wafer with a supporting ring is formed by attaching the supporting ring to an outer circumferential portion of the wafer before polishing and polishing is performed on the wafer with a supporting ring, whereby the outer peripheral sag is reduced, has been disclosed (refer to Patent Literature 2).

CITATION LIST

Patent Literature 1: Japanese Unexamined Patent publication (Kokai) No. 2005-158798

Patent Literature 2: Japanese Unexamined Patent publication (Kokai) No. 2004-241723

SUMMARY OF INVENTION

One of the causes of the outer peripheral sag generated at the time of double-side polishing is the influence of creep deformation associated with the viscoelasticity characteristics of the polishing pad. This is a problem described below. As shown in FIG. 7, when an edge portion of a wafer W to be polished is chamfered, a gap is formed between an inner circumferential portion of a resin ring 102 and a chamfered portion 112 of the wafer, and a sag is generated on the outermost circumference of the wafer W when a creep deformed polishing pad 105 enters the gap.

The above-described generation of the sag due to creep deformation of the polishing pad can be prevented by, for example, performing polishing after attaching the supporting ring to the outer circumferential portion of the wafer as described above. However, in such a conventional method, since the wafer is fixed during polishing, the generation of taper in the polished surface of the wafer cannot be reduced by making the wafer rotate Therefore, the flatness cannot be improved sufficiently.

The present invention has been made in view of the problems described above, and an object thereof is to provide a carrier for a double-side polishing apparatus, a double-side polishing apparatus using the carrier, and a double-side polishing method that can reduce the generation of taper in a polished surface and improve the flatness by making the wafer rotate during polishing while suppressing the generation of the outer peripheral sag of the wafer due to creep deformation of the polishing pad.

To achieve the above object, the present invention provides a carrier for a double-side polishing apparatus, the carrier in a double-side polishing apparatus which polishes both surfaces of a wafer having a chamfered portion on an outer edge thereof, the carrier including at least: a carrier base placed between upper and lower turn tables to which polishing pads are attached, the carrier base having a holding hole formed therein, the holding hole for holding the wafer sandwiched between the upper and lower turn tables at the time of polishing; and a ring-shaped resin ring disposed along an inner circumference of the holding hole of the carrier base, the resin ring protecting the chamfered portion by making contact with the chamfered portion of the held wafer, wherein the resin ring has a concave groove on an inner circumference thereof, and the wafer is held with upper and lower tapered surfaces and the chamfered portion of the wafer made cross-sectional point contact with each other, the upper and lower tapered surfaces being formed in the concave groove.

As described above, when the carrier comprises the carrier base placed between upper and lower turn tables to which polishing pads are attached, the carrier base having a holding hole formed therein, the holding hole for holding the wafer sandwiched between the upper and lower turn tables at the time of polishing; and the ring-shaped resin ring disposed along an inner circumference of the holding hole of the carrier base, the resin ring protecting the chamfered portion by making contact with the chamfered portion of the held wafer, and when the resin ring has a concave groove on an inner circumference thereof, and the wafer is held with upper and lower tapered surfaces and the chamfered portion of the wafer made cross-sectional point contact with each other, the upper and lower tapered surfaces being formed in the concave groove, the generation of taper in the polished surface can be reduced by making the wafer rotate during polishing while suppressing the generation of the outer peripheral sag by reducing a gap between the chamfered portion of the wafer and the inner circumferential portion of the resin ring, and the flatness of the wafer to be polished can be improved.

At this time, it is preferable that, when an angle of the tapered surfaces of the concave groove with respect to upper and lower main surfaces of the resin ring, the tapered surfaces making contact with the wafer, and the chamfering angle of the wafer are $\beta$ and $\theta$, respectively, the upper and lower tapered surfaces of the concave groove and the chamfered portion of the wafer make cross-sectional point contact with each other when $\theta<\beta<90°$ is satisfied.

As described above, by satisfying $\theta<\beta<90°$ when the angle of the tapered surfaces of the concave groove with respect to upper and lower main surfaces of the resin ring, the tapered surfaces making contact with the wafer, and the chamfering angle of the wafer are $\beta$ and $\theta$, respectively, the upper and lower tapered surfaces of the concave groove and the chamfered portion of the wafer can be surely made cross-sectional point contact with each other.

Moreover, at this time, it is preferable that the angle $\beta$ of the tapered surfaces of the concave groove with respect to the upper and lower main surfaces of the resin ring satisfies $\theta<\beta\leqq\theta+7°$, the tapered surfaces making contact with the wafer.

As described above, when the angle $\beta$ of the tapered surfaces of the concave groove with respect to upper and lower main surfaces of the resin ring satisfies $\theta<\beta\leqq\theta+7°$, the tapered surfaces making contact with the wafer, it is possible to reduce the gap between the chamfered portion of the wafer and the inner circumferential portion of the resin ring sufficiently, and reduce the generation of the outer peripheral sag more effectively. Furthermore, a wafer-holding power can be enhanced.

In addition, the present invention provides a double-side polishing apparatus including at least the carrier for a double-side polishing apparatus, the carrier according to the present invention.

As described above, with the double-side polishing apparatus including the carrier for a double-side polishing apparatus, the carrier according to the present invention, the flatness can be improved by suppressing the generation of the outer peripheral sag and the taper of the wafer to be polished.

Moreover, the present invention provides a wafer double-side polishing method for performing double-side polishing on a wafer, wherein the carrier for a double-side polishing apparatus, the carrier according to the present invention, is placed between upper and lower turn tables to which polishing pads are attached, the wafer is held with the upper and lower tapered surfaces of the concave groove of the resin ring and the chamfered portion of the wafer made cross-sectional point contact with each other, the resin ring being disposed along the inner circumference of the holding hole of the carrier, and double-side polishing is performed with the wafer sandwiched between the upper and lower turn tables.

As described above, by placing the carrier for a double-side polishing apparatus, the carrier according to the present invention, between upper and lower turn tables to which polishing pads are attached, the wafer is held with the upper and lower tapered surfaces of the concave groove of the resin ring and the chamfered portion of the wafer make cross-sectional point contact with each other, the resin ring being disposed along the inner circumference of the holding hole of the carrier, and performing double-side polishing with the wafer sandwiched between the upper and lower turn tables, the flatness can be improved by suppressing the generation of the outer peripheral sag and the taper of the wafer to be polished.

In the carrier for a double-side polishing apparatus according to the present invention, the resin ring has the concave groove on the inner circumference thereof, and the wafer is held with upper and lower tapered surfaces and a chamfered portion of a wafer made cross-sectional point contact with each other, the upper and lower tapered surfaces being formed in the concave groove. Therefore, by performing polishing by using the double-side polishing apparatus provided with this carrier for a double-side polishing apparatus, the generation of taper in the polished surface can be suppressed by making the wafer rotate during polishing while suppressing the generation of the outer peripheral sag by reducing the gap between the chamfered portion of the wafer and the inner circumferential portion of the resin ring, and the flatness of the wafer to be polished can be improved.

DESCRIPTION OF EMBODIMENTS

Hereinafter, an embodiment of the present invention will be explained; however, the present invention is not limited thereto. In conventional double-side polishing of a wafer, the creep deformation associated with the viscoelasticity characteristics of a polishing pad may occur during polishing and, in the event that the edge portion of the wafer is chamfered, a sag is generated on the outer circumference of the wafer as a result of the creep deformed polishing pad entering the gap between the inner circumferential portion of the resin ring and the chamfered portion of the wafer in some cases. This becomes a cause of deterioration of the flatness of the wafer.

Conventionally, to suppress such an outer peripheral sag, for example, the shape of the inner circumferential portion of the resin ring to be made contact with the wafer is formed according to the shape of the chamfered portion of the wafer, they are bonded, and thereafter polishing is performed. The outer peripheral sag can be thereby suppressed. However, this inhibited the wafer from rotating at the time of polishing, and therefore it was impossible to suppress the generation of the taper in the polished surface of the wafer and improve the flatness sufficiently.

In view of this, the present inventor has studied intensively to solve the problems described above. As a result of the study, the present inventor has found out that, by means of holding the wafer with the upper and lower tapered surfaces that is formed in the concave groove of the resin ring and the chamfered portion of the wafer made cross-sectional point contact with each other, while suppressing the creep deformed polishing pad entering the gap between the chamfered portion of the wafer and the inner circumferential portion of the resin ring by forming the concave groove in the inner circumferential portion of the resin ring to reduce the gap, it is possible to minimize the chances of inhibiting the wafer from rotating and thereby suppress the generation of both of the outer peripheral sag and the taper, and has brought the present invention to completion.

Figure 1:
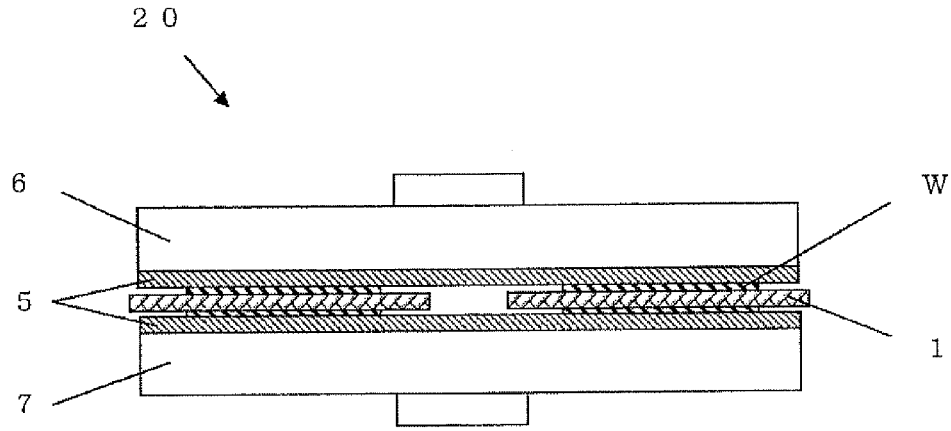
FIG. 1 is a schematic sectional view showing an example of the double-side polishing apparatus according to the present invention.
Figure 2:
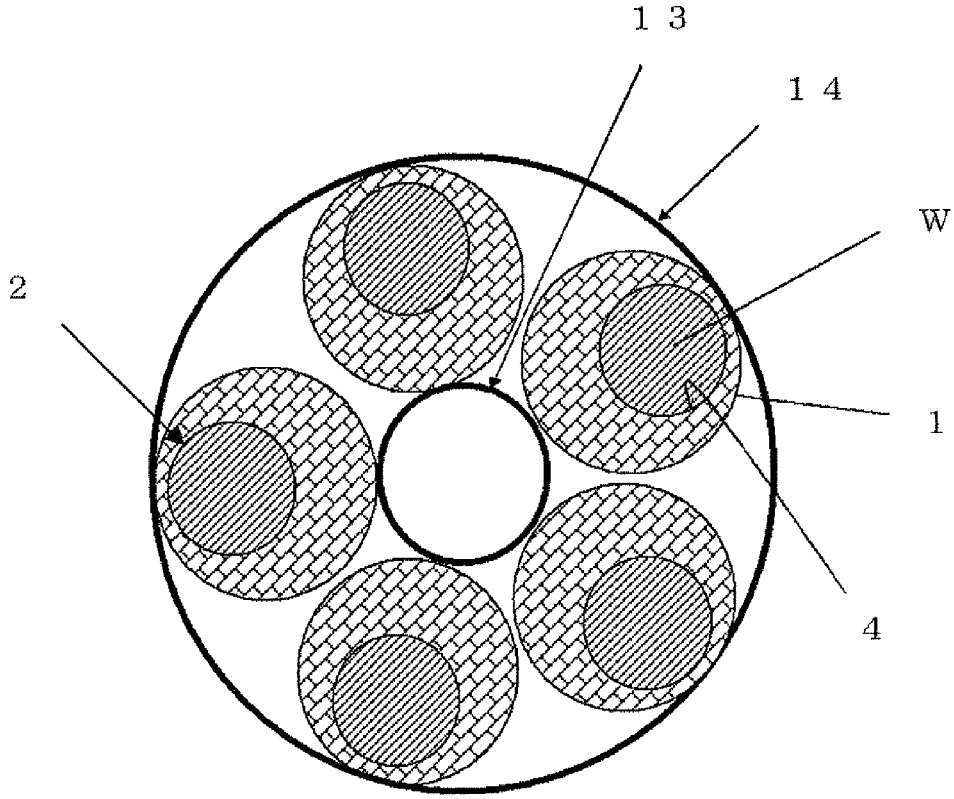
FIG. 2 is an internal structure view of the double-side polishing apparatus of the present invention as seen in a plan view.

Here, FIG. 1 is a schematic sectional view of the double-side polishing apparatus provided with the carrier for a double-side polishing apparatus, according to the invention, and FIG. 2 is an internal structure view of the double-side polishing apparatus as seen in a plan view.

As shown in FIGS. 1 and 2, the double-side polishing apparatus 20 provided with the carrier for a double-side polishing apparatus 1, according to the present invention, includes an upper turn table 6 and a lower turn table 7 which are provided so as to face each other vertically, and a polishing pad 5 is attached to each of the faces of the turn tables 6 and 7, the faces at which the turn tables 6 and 7 face each other. In addition, a sun gear 13 is provided in a central portion located between the upper turn table 6 and the lower turn table 7, and an internal gear 14 is provided in an edge portion thereof. The wafer W is held in the holding hole 4 of the carrier for a double-side polishing apparatus 1, and is sandwiched between the upper turn table 6 and the lower turn table 7.

Moreover, an outer circumferential gear teeth of the carrier for a double-side polishing apparatus 1 mesh with each gear tooth portion of the sun gear 13 and the internal gear 14, and, when the upper turn table 6 and the lower turn table 7 are rotated by an unillustrated drive source, the carrier for a double-side polishing apparatus 1 is revolved about the sun gear 13 while rotating. At this time, the wafer W is held in the holding hole 4 of the carrier for a double-side polishing apparatus 1, and both surfaces are polished simultaneously by the upper and lower polishing pads 5. In addition, at the time of polishing, a polishing solution is supplied from an unillustrated nozzle.

Figure 3:
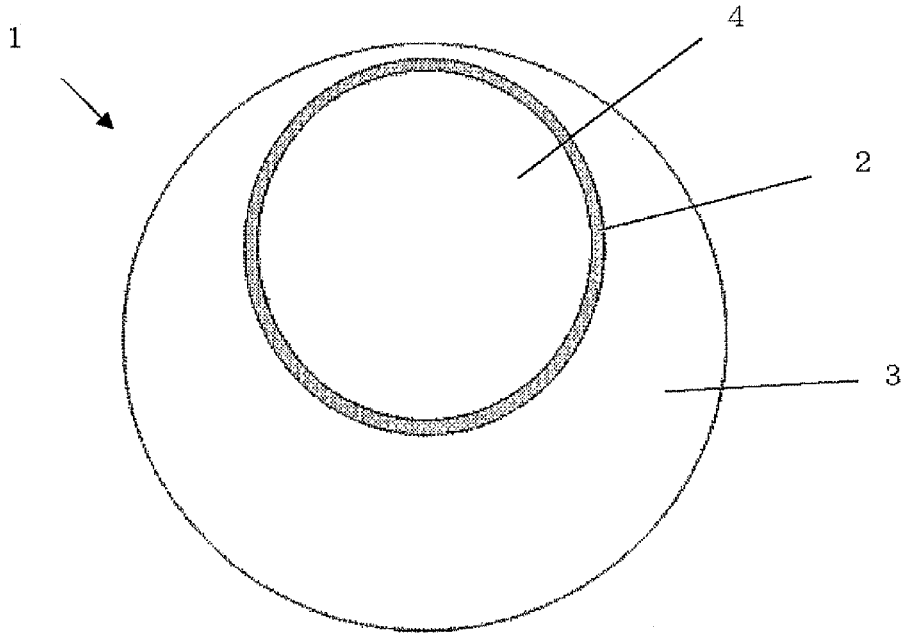
FIG. 3 is a schematic view showing an example of the carrier for a double-side polishing apparatus, the carrier according to the present invention.

Furthermore, as shown in FIG. 3, the carrier for a double-side polishing apparatus 1 has the carrier base 3 made of metal in which the holding hole 4 for holding the wafer W is formed. In addition, the resin ring 2 is disposed along the inner circumferential surface of the holding hole 4 of the carrier base 3. With the resin ring 2, the damage of the edge portion of the wafer W can be prevented, the damage which is caused by the wafer W being made contact with the metal carrier base 3 during polishing.

In addition, the wafer W is inserted into the holding hole 4 of the carrier for a double-side polishing apparatus 1 and is held, the holding hole 4 having the above-described resin ring 2 disposed along the inner circumferential surface thereof.

Figure 4:
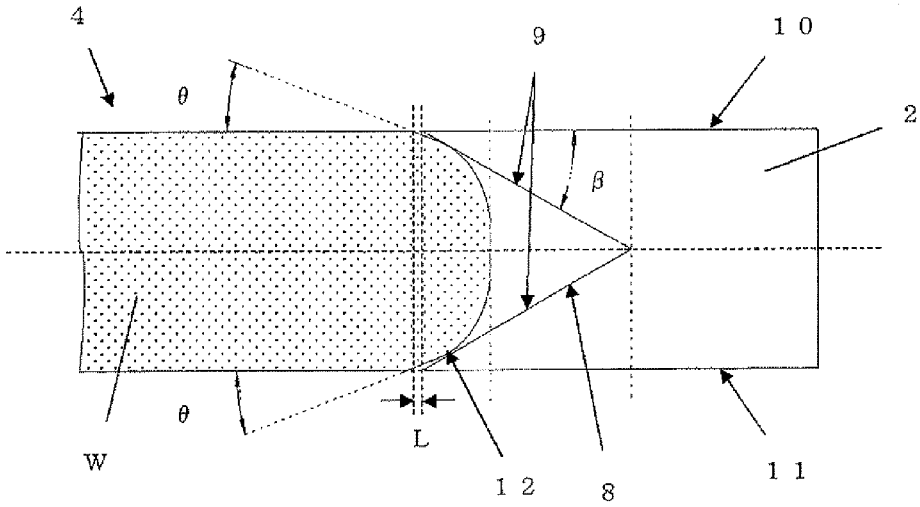
FIG. 4 is a schematic sectional view showing a state in which the edge portion (the chamfered portion) of the wafer makes cross-sectional point contact with an inner circumference (upper and lower tapered surfaces of the concave groove) of the resin ring of the carrier for a double-side polishing apparatus, the carrier according to the present invention, and showing the shape of the concave groove of the resin ring.

Here, FIG. 4 is a schematic sectional view showing a state in which the wafer W is inserted into the holding hole 4 of the carrier for a double-side polishing apparatus 1 and the edge portion of the wafer W makes contact with the inner circumference of the resin ring 2.

As shown in FIG. 4, the edge portion of the wafer W to be polished is chamfered, and has the chamfered portion 12. Moreover, the concave groove 8 is formed on the inner circumference of the resin ring 2. Furthermore, the concave groove 8 has tapered surfaces 9 formed in upper and lower portions thereof.

In addition, the upper and lower tapered surfaces 9 of the concave groove 8 and the chamfered portion 12 of the wafer W make cross-sectional point contact with each other, and the wafer W is held in such a cross-sectional point contact state. Here, the cross-sectional point contact means a state in which they make point contact with each other when a contact spot is seen in cross-section. Therefore, in the present invention, the upper and lower tapered surfaces 9 and the chamfered portion 12 of the wafer W make contact with each other at upper and lower two points.

As described above, by holding the wafer W with the upper and lower tapered surfaces 9 that is formed in the concave groove 8 of the resin ring 2 and the chamfered portion 12 of the wafer W made cross-sectional point contact with each other, it is possible to minimize the chances of inhibiting the wafer W from rotating during polishing.

As described above, when the carrier for a double-side polishing apparatus is configured such that the concave groove 8 is formed on the inner circumference of the resin ring 2, and the wafer W is held with the upper and lower tapered surfaces 9 of the concave groove 8 and the chamfered portion 12 of the wafer W made cross-sectional point contact with each other, the gap L between the chamfered portion 12 of the wafer W and the inner circumferential portion of the resin ring 2 can be reduced by performing polishing by using the double-side polishing apparatus provided with this carrier for a double-side polishing apparatus, according to the present invention, and the creep deformed polishing pad 5 entering the gap can be suppressed and thereby the outer peripheral sag can be suppressed.

In addition to that, when the wafer W is held with the upper and lower tapered surfaces 9 of the concave groove 8 and the chamfered portion 12 of the wafer W made cross-sectional point contact with each other, the wafer W can rotate during polishing, and the generation of taper in the polished surface can be suppressed. As a result, there is no need to perform a process for improving the flatness by adding an extra polishing process, and the flatness of the wafer W to be polished can be improved only with one polishing process.

At this time, it is preferable that, when the angle of the tapered surfaces 9 of the concave groove 8 with respect to the upper and lower main surfaces 10 and 11 of the resin ring 2, the tapered surfaces 9 making contact with the wafer W, and the chamfering angle of the wafer W are $\beta$ and $\theta$, respectively, the upper and lower tapered surfaces 9 of the concave groove 8 and the chamfered portion 12 of the wafer W make cross-sectional point contact with each other when $\theta<\beta<90°$ is satisfied.

As described above, by satisfying $\theta<\beta<90°$, the upper and lower tapered surfaces 9 of the concave groove 8 and the chamfered portion 12 of the wafer can be surely made cross-sectional point contact with each other.

Figure 5:
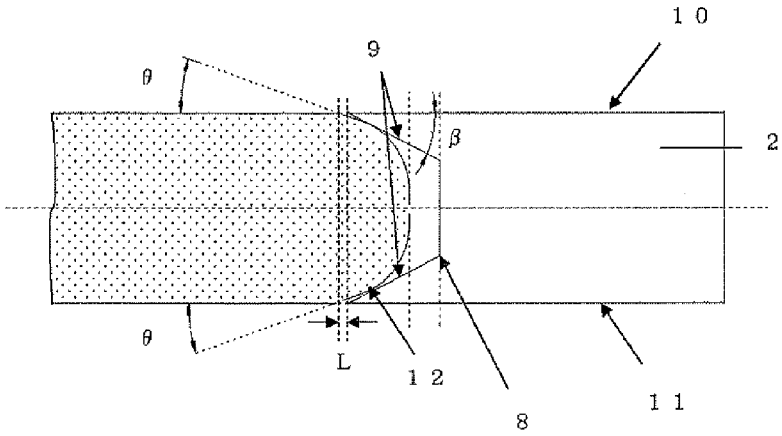
FIG. 5 is a schematic sectional view showing an another shape of the concave groove of the resin ring of the carrier for a double-side polishing apparatus, the carrier according to the present invention.

Here, the chamfering angle $\theta$ of the wafer is the angle $\theta$ shown in FIGS. 4 and 5, and is defined as an angle of an intersection point of a tangent at an R end, the tangent extending toward the wafer surface side of the chamfered portion 12 of the wafer W, and a horizontal line from the surface of the wafer.

It is to be noted that, in FIGS. 2 and 3, each carrier for a double-side polishing apparatus 1 holds one wafer W, but a plurality of wafers W may be held in each carrier for a double-side polishing apparatus by using the carrier for a double-side polishing apparatus, having a plurality of holding holes.

Here, the shape of the concave groove 8 of the resin ring 2 only needs to have the upper and lower tapered surfaces 9 formed therein, the upper and lower tapered surfaces 9 which make cross-sectional point contact with the chamfered portion 12 of the wafer W. For example, the shape etc. of the deepest portion of the concave groove 8 is not particularly limited to a V-shaped groove. For example, the concave groove 8 may be a trapezoidal concave groove 8 shown in FIG. 5.

At this time, the angle $\beta$ of the tapered surfaces 9 of the concave groove 8 with respect to the upper and lower main surfaces 10 and 11 of the resin ring 2 preferably satisfies $\theta<\beta\leqq\theta+7°$, the tapered surfaces 9 with which the wafer W makes contact.

For example, when the chamfering angle of the wafer W is 18°, the gap L between the chamfered portion 12 of the wafer W and the inner circumferential portion of the resin ring 2 can be sufficiently reduced when the angle $\beta$ of the tapered surfaces 9 of the concave groove 8 with respect to the upper and lower main surfaces 10 and 11 of the resin ring 2 satisfies $18°<\beta\leqq25°$, the tapered surfaces 9 making contact with the wafer W. This makes it possible to suppress the creep deformed polishing pad 5 entering the gap more effectively. Moreover, the wafer-holding power can be enhanced.

Furthermore, in the wafer double-side polishing method according to the present invention, for example, the carrier for a double-side polishing apparatus 1, the carrier shown in FIG. 3 and having the resin ring 2 shown in FIGS. 4 and 5, and the double-side polishing apparatus 20 shown in FIG. 1 and provided with the carrier for a double-side polishing apparatus 1 are used, and the carrier for a double-side polishing apparatus 1 is first placed between the upper and lower turn tables 6 and 7 of the double-side polishing apparatus 20, the upper and lower turn tables 6 and 7 to which the polishing pads 5 are attached.

Next, the wafer W is inserted into the holding hole 4 of the carrier for a double-side polishing apparatus 1, and is held with the upper and lower tapered surfaces 9 of the concave groove 8 of the resin ring 2 that is disposed along the inner circumference of the holding hole 4 of the carrier for a double-side polishing apparatus 1 and the chamfered portion 12 of the wafer W made cross-sectional point contact with each other.

The upper and lower polished surfaces of the wafer W are thereafter sandwiched between the polishing pads 5 attached to the upper and lower turn tables 6 and 7, and polishing is performed while a polishing agent is supplied to the polished surfaces.

By performing polishing in the manner described above, the generation of taper in the polished surface can be reduced by making the wafer W rotate during polishing, while suppressing the outer peripheral sag by suppressing the creep deformed polishing pad 5 entering the gap L between the chamfered portion 12 of the wafer W and the inner circumferential portion of the resin ring 2 by reducing the gap L. As a result, it is possible to improve the flatness of the wafer W to be polished only with one polishing process without adding an extra polishing process.

Hereinafter, the present invention will be explained more specifically based on Example and Comparative Example of the present invention; however, the present invention is not limited thereto.

EXAMPLE

By using the carrier for a double-side polishing apparatus, shown in FIGS. 3 and 4, and the double-side polishing apparatus shown in FIG. 1 and provided with the carrier for a double-side polishing apparatus, double-side polishing was performed on 250 silicon wafers having a diameter of 300 mm, and the flatness (SFQR (max)) of the surface of each of the polished wafers was measured by a flatness measuring instrument (WaferSight M49 mode/Cell Size: 26×8 mm/Offset: 0×0 mm/Edge Exclusion: 2 mm).

It is to be noted that the SFQR (site front least squares range) represents, when an in-site plane calculated by applying the least squares method to data in a set site with a wafer back surface corrected to a plane is regarded as a reference plane, a difference between maximum and minimum positional displacement from this plane for each site, and (max) refers to the maximum difference of each site.

Here, the wafers were chamfered before polishing, and the chamfering angle thereof was 18°. Moreover, the inner diameter of the resin ring was 300.5 mm, the width of the resin ring was 1700 μm, and $\beta$ was 25°. The wafer is preferably held by setting a difference between the inner diameter of the resin ring and the wafer diameter so as to be equal to or less than 2 mm. Moreover, it is preferable in terms of strength that the width of the resin ring is set in the range of 1500 to 2000 μm. At this time, the gap L between the chamfered portion of the wafer and the inner circumferential portion of the resin ring was 42 μm.

Figure 6:
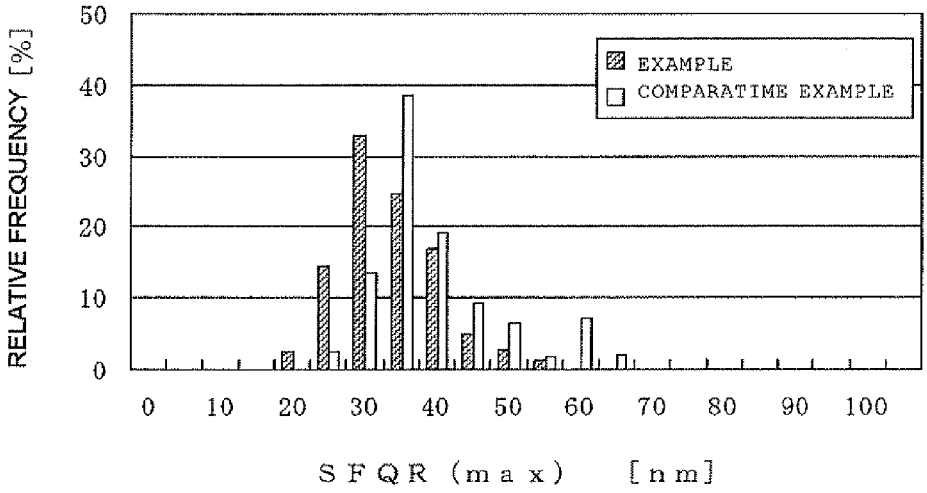
FIG. 6 is a view showing the results of the example and the comparative example.

The results are shown in FIG. 6. As shown in FIG. 6, it is clear that the SFQR (max) is improved as compared to the results of the later-described Comparative Example. In addition, the average value of the SFQR (max) is 26.65 nm and is improved as compared to 32.56 nm of Comparative Example, and an improvement ratio is 22.18%.

As described above, it has been confirmed that, by performing double-side polishing by using the carrier for a double-side polishing apparatus, according to the present invention, it is possible to reduce the generation of taper in the polished surface by making the wafer rotate during polishing, while suppressing the outer peripheral sag by suppressing the creep deformed polishing pad entering the gap, and improve the flatness of the wafer to be polished.

COMPARATIVE EXAMPLE

Figure 7:
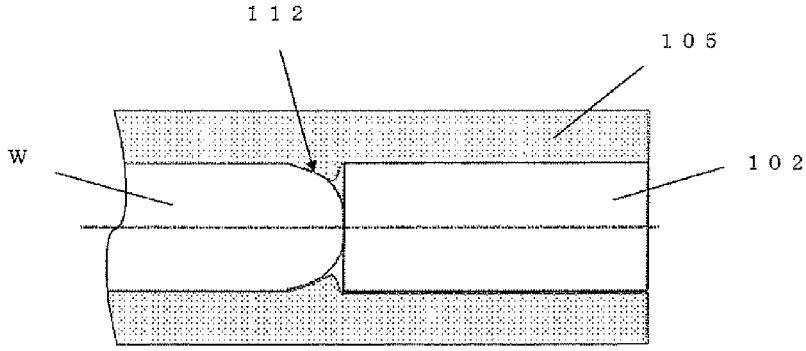
FIG. 7 is an explanatory view showing a state in which, when polishing is performed by using a resin ring in a conventional carrier for a double-side polishing apparatus, a creep deformed polishing pad enters the gap between the inner circumferential portion of the resin ring and the chamfered portion of the wafer.

Under the same conditions as those of Example except that a double-side polishing apparatus provided with a conventional carrier for a double-side polishing apparatus, the carrier shown in FIG. 7 and having a resin ring with no concave groove, 250 wafers were polished, and the flatness was measured in the same manner as Example.

The results are shown in FIG. 6. The average value of the SFQR (max) was 32.56 nm. As described above, it is clear that the flatness is deteriorated as compared to the results of Example.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A carrier for a double-side polishing apparatus which polishes both surfaces of a wafer having a chamfered portion on an outer edge thereof, the carrier comprising at least:

a carrier base placed between upper and lower turn tables to which polishing pads are attached, the carrier base having a holding hole formed therein, the holding hole capable of holding the wafer sandwiched between the upper and lower turn tables at the time of polishing; and a ring-shaped resin ring disposed along an inner circumference of the holding hole of the carrier base, the resin ring for protecting the chamfered portion by contacting the chamfered portion of the held wafer, wherein the resin ring has a concave groove on an inner circumference thereof, the concave groove having an upper tapered surface and a lower tapered surface, and the wafer is capable of being held at the chamfered portion by the upper and lower tapered surfaces of the concave groove, the upper and lower tapered surfaces of the concave groove and the chamfered portion of the wafer forming a cross-sectional point contact, wherein an angle $\beta$ of the upper and lower tapered surfaces of the concave groove with respect to the upper and lower main surfaces of the resin ring, respectively, satisfies an expression $\theta<\beta\leqq\theta+7°$, wherein $\theta$ represents a chamfering angle of the wafer to be held.

2. A double-side polishing apparatus including at least the carrier according to claim 1.

3. A wafer double-side polishing method for performing double-side polishing on a wafer, the method comprising:

placing the carrier according to claim 1 between upper and lower turn tables to which polishing pads are attached;

holding the wafer at the chamfered portion by the upper and lower tapered surfaces of the concave groove of the resin ring disposed along the inner circumference of the holding hole of the carrier to form the cross-sectional point contact; and performing double-side polishing with the wafer sandwiched between the upper and lower turn tables.

* * * * *